US007651038B2

(12) United States Patent
Shimizu et al.

(10) Patent No.: US 7,651,038 B2
(45) Date of Patent: Jan. 26, 2010

(54) FUEL INJECTION VALVE FOR INTERNAL COMBUSTION ENGINE

(75) Inventors: Nobuyuki Shimizu, Susono (JP); Tomojiro Sugimoto, Susono (JP)

(73) Assignee: Toyota Jidosha Kabuhsiki Kaisha, Toyota-shi (JP)

( * ) Notice: Subject to any disclaimer, the term of this patent is extended or adjusted under 35 U.S.C. 154(b) by 388 days.

(21) Appl. No.: 11/476,112

(22) Filed: Jun. 28, 2006

(65) Prior Publication Data

US 2007/0012803 A1 Jan. 18, 2007

(30) Foreign Application Priority Data

Jun. 29, 2005 (JP) ..... 2005-189646

(51) Int. Cl.

| | |
|---|---|
| ***F02M 61/00*** | (2006.01) |
| ***F02M 39/00*** | (2006.01) |
| ***B05B 1/30*** | (2006.01) |
| ***B05B 1/26*** | (2006.01) |
| ***A62C 31/02*** | (2006.01) |
| ***B05D 3/02*** | (2006.01) |

(52) U.S. Cl. ..... 239/533.12; 239/533.3; 239/584; 239/601; 239/DIG. 19; 427/388.5

(58) Field of Classification Search ..... 239/497, 239/584, 596, 601, 602, DIG. 19, 533.3, 239/533.12; 427/388.5

See application file for complete search history.

(56) References Cited

U.S. PATENT DOCUMENTS 5,373,993 A * 12/1994 Flynn et al. ..... 239/591
5,478,651 A * 12/1995 Tannenbaum ..... 428/422
5,772,124 A 6/1998 Tamaki et al.
2007/0259121 A1* 11/2007 Shiratani et al. ..... 427/388.5

FOREIGN PATENT DOCUMENTS

| | | | |
|---|---|---|---|
| JP | 9-32695 | | 2/1997 |
| JP | 10-159687 | | 6/1998 |
| JP | 10159687 | A * | 6/1998 |
| JP | 10193514 | A * | 7/1998 |
| JP | 11-343481 | | 12/1999 |
| JP | 2003-227445 | | 8/2003 |
| JP | 2004-211851 | | 7/2004 |
| JP | 2004-346817 | | 12/2004 |

* cited by examiner

*Primary Examiner*—Len Tran
*Assistant Examiner*—Ryan Reis
(74) *Attorney, Agent, or Firm*—Oblon, Spivak, McClelland, Maier & Neustadt, L.L.P.

(57) ABSTRACT

A fuel injection valve for an internal combustion engine is such that an inside wall of a nozzle hole through which fuel is injected into a combustion chamber or an intake port of the internal combustion engine is coated with a composite coating formed of a lipophilic portion and an oil repelling portion which are finely interspersed on the nano order. The inside wall of the nozzle hole is formed by multiple grooves extending in the fuel jet direction and flat portions between these grooves, and inside walls of the grooves are coated with an oil repellant coating and the flat portions are coated with a lipophilic coating.

5 Claims, 4 Drawing Sheets

FUEL INJECTION VALVE FOR INTERNAL COMBUSTION ENGINE

INCORPORATION BY REFERENCE

The disclosure of Japanese Patent Application No. 2005-189646 filed on Jun. 29, 2005, including the specification, drawings and abstract is incorporated herein by reference in its entirety.

BACKGROUND OF THE INVENTION

1. Field of the Invention

The invention relates to an improved fuel injection valve for an internal combustion engine, which reduces exhaust emissions such as HC by atomizing the fuel spray.

2. Description of the Related Art

In an internal combustion engine such as an automobile engine, finer spray results in fuel burning more completely, which in turn results in greater engine performance and less exhaust emissions.

Japanese Patent Application Publication No. JP-A-9-32695 (Japanese Patent No. 3156554) discloses a structure in which the flow of fuel through a cylindrical fuel seal portion (a needle) (i.e., vertical flow) is converted into a flow between a flowrate measuring portion and the needle (i.e., lateral flow) and the fuel is led to a nozzle hole as it flows toward the center of the fuel injection valve. A strong vortex flow is generated by splitting the flow at the needle-side entrance port of the nozzle hole. This strong vortex flow helps to atomize the spray.

Because this method splits the flow of fuel on the needle side of the nozzle hole, however, the flow tends to concentrate at the inside wall surface of the nozzle hole on the center side of the fuel injection valve, which may increase the thickness of a fuel liquid film flowing over the inside wall of the nozzle hole. If this fuel liquid film becomes thick, it takes a lot of energy to break up the liquid film injected from the nozzle hole into particles. Therefore, the fuel liquid film is not easily broken up into spray particles immediately after injection. That is, the fuel liquid film is injected as a thick liquid film (in a liquid cylinder shape) so it takes time to break up into spray particles, which inhibits atomization.

The reason why the fuel liquid film is injected in this state is because the surface tension relationship between the fuel and the inside wall surface (which is usually stainless steel or the like) of the nozzle hole makes it difficult for the fuel to spread along the inside wall surface, and as a result, the fuel liquid film is distributed toward the side where the flow is strong on the nozzle hole inside wall surface such that the thickness of the fuel film becomes uneven.

Japanese Patent Application Publication No. JP-A-11-343481 discloses technology in which an oil repellant coating is applied to the inside wall of a nozzle hole in order to suppress fuel deposits from forming thereon, and Japanese Patent Application Publication No. JP-A-2003-227445 discloses technology in which a groove that is perpendicular to the direction in which fuel flows is formed on the inside wall of the nozzle hole in order to realize atomization. Neither of these technologies, however, achieve sufficient atomization effects so further improvement is necessary.

Further, in contrast to Japanese Patent Application Publication No. JP-A-11-343481, Japanese Patent Application Publication No. JP-A-2004-346817 discloses technology for improving spray atomization by applying a titanium oxide coating that has a lipophilic property to the inside wall of the nozzle hole. The problem with this technology, however, is that it results in increased pressure loss.

SUMMARY OF THE INVENTION

This invention thus provides an improved fuel injection valve for an internal combustion engine, which reduces exhaust emissions such as HC by atomizing the fuel spray.

A first aspect of the invention provides a fuel injection valve for an internal combustion engine in which an inside wall of a nozzle hole through which fuel is injected into a combustion chamber or an intake port of the internal combustion engine is coated with a composite coating formed of a lipophilic portion and an oil repelling portion which are finely interspersed on the nano order.

According to this first aspect, a lipophilic portion and an oil repelling portion, which together form the composite coating that coats the inside wall of the nozzle hole, are finely dispersed on the nano order and thus act on the fuel liquid film in the nozzle hole on the molecular level. As a result, good wettability of the fuel liquid film with respect to the nozzle hole inside wall is ensured such that the fuel liquid film spreads thinly over the nozzle hole inside wall, resulting in spray atomization. At the same time, the surface tensions of the composite coating and the fuel liquid film are equal so the fuel liquid film remains thin as it slides over the inside wall of the nozzle hole. As a result, energy loss, i.e., pressure loss, in the nozzle hole does not increase.

A second aspect of the invention relates to a fuel injection valve for an internal combustion engine in which an inside wall of a nozzle hole through which fuel is injected into a combustion chamber or an intake port of the internal combustion engine is formed by multiple grooves extending in the fuel jet direction and flat portions between these grooves, and inside walls of the grooves are coated with an oil repellant coating and the flat portions are coated with a lipophilic coating.

According to this second aspect, wettability is increased at the lipophilic flat portions so the fuel liquid film spreads out to form a thin film. At the same time, shearing force generated by the difference in sliding (i.e., flow) rates of the fuel at the boundary between the oil repellant grooves and the lipophilic flat portions rips the fuel liquid film apart such that the fuel forms liquid threads in the grooves. As a result, the spray is atomized by breaking up the injected liquid threads in the lengthwise direction.

Both the first and second aspects described above are able to achieve atomization of the fuel spray.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

The principle of spray atomization according to a first example embodiment of the invention will now be described with reference to FIGS. 1, 2, and 3.

Figure 1A:
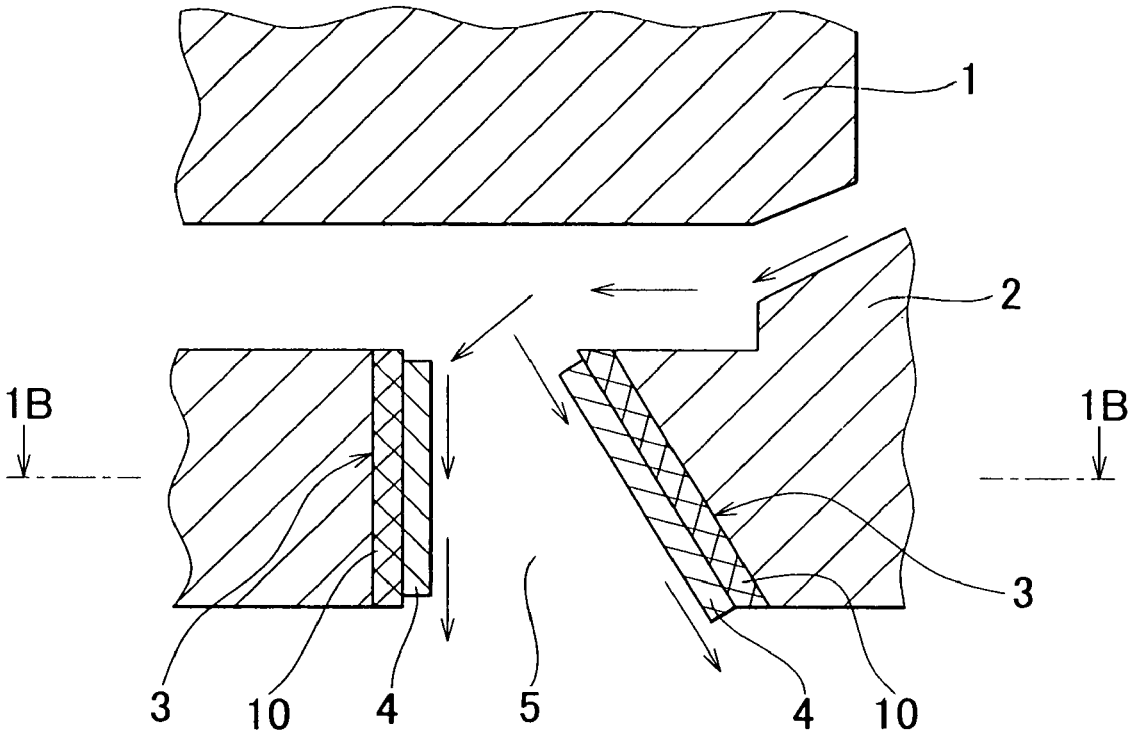
FIG. 1 is a sectional view of an area near a nozzle hole of a fuel injection valve for an internal combustion engine according to a first example embodiment of the invention, with FIG. 1A being a longitudinal sectional view in the lengthwise direction of the nozzle hole and FIG. 1B being a transverse sectional view taken along line 1B-1B in FIG. 1A.
Figure 1B:
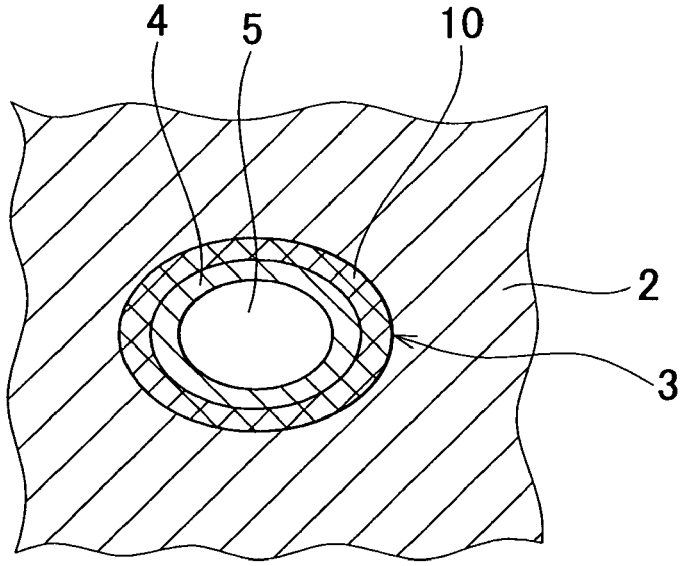

FIG. 1 is a sectional view of an area near a nozzle hole of a fuel injection valve for an internal combustion engine according to a first example embodiment of the invention, with FIG. 1A being a longitudinal sectional view in the lengthwise direction of the nozzle hole and FIG. 1B being a transverse sectional view taken along line 1B-1B in FIG. 1A.

FIG. 1A shows a state in which a needle valve 1 has been lifted to an open position such that fuel flows as shown by the arrows and sprays out (into a combustion chamber) from a nozzle hole 3 of a valve body 2.

A characteristic of this first example embodiment is that the inside wall of the nozzle hole 3 is covered by a lipophilic (PES)/oil repelling (FEP) composite coating 10. Inside the nozzle hole 3, fuel flows as a liquid film 4 over the surface of the composite coating 10 coated on the inside wall of the nozzle hole 3. That is, the liquid film 4 is shaped like a cylinder that spreads around the entire inside wall of the nozzle hole 3 and has a residual air layer 5 inside it, as shown in FIG. 1B.

Figure 2A:
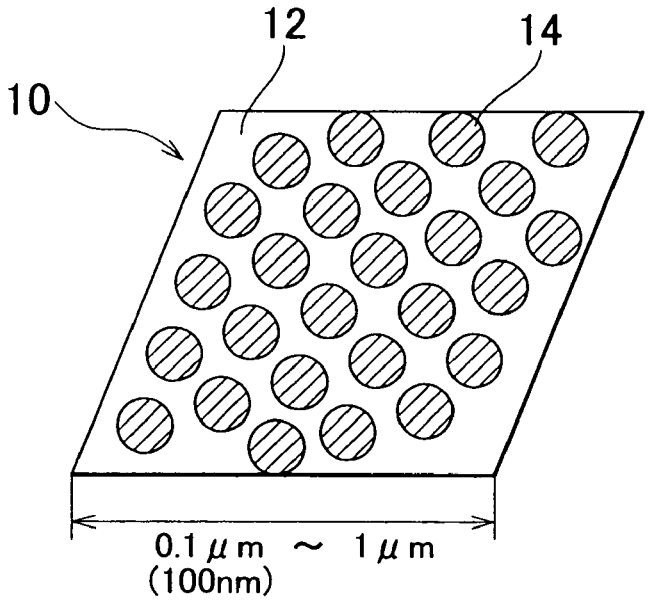
FIG. 2 is a perspective view showing structural patterns of a composite coating according to the first example embodiment of the invention, with FIG. 2A being that oil repelling portions are formed of individual particles and FIG. 2B being that oil repelling portions are formed of a plurality of particles.

FIG. 2A is a pattern diagram showing the structure of the composite coating 10 according to the first example embodiment of the invention. An oil repelling FEP (ethylene tetrafluoride-propylene hexafluoride copolymer) 14 is finely dispersed on the nano order in a lipophilic PES (polyethersulphone) 12. For example, several tens of FEP particles 14 are finely dispersed in a 0.1 μm (100 nm) to 1 μm square PES matrix 12, as shown in the drawing. That is, the size of the FEP oil repelling portions is on the order of several nm to several tens of nm, and the size of the PES lipophilic portions (i.e., the intervals between the FEP oil repelling portions) is also on the order of several nm to several tens of nm.

Figure 2B:
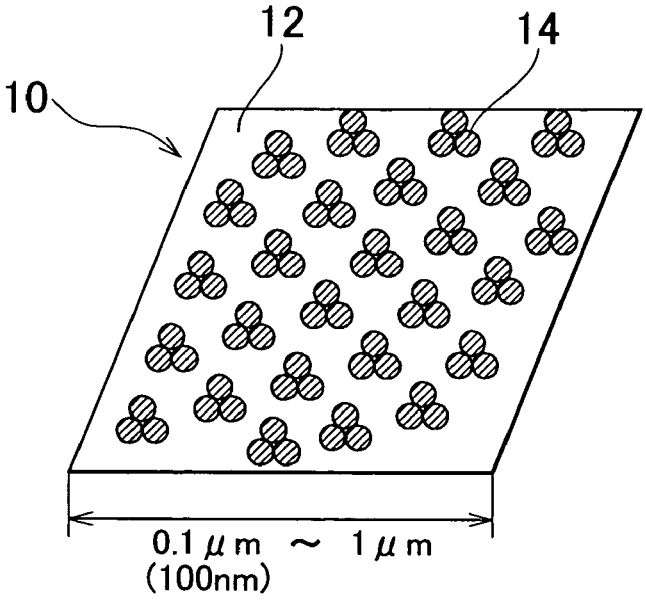

The FEP oil repelling portions 14 may be formed of individual particles, as shown in FIG. 2A, or of a plurality of particles, as shown in FIG. 2B. Also, FIG. 2B shows each FEP oil repelling portion 14 being formed of three particles, but not all of the FEP oil repelling portions 14 always have to be formed of the same number of particles. Each FEP oil repelling portion 14 is typically formed of either one or a plurality of particles.

Figure 3A:
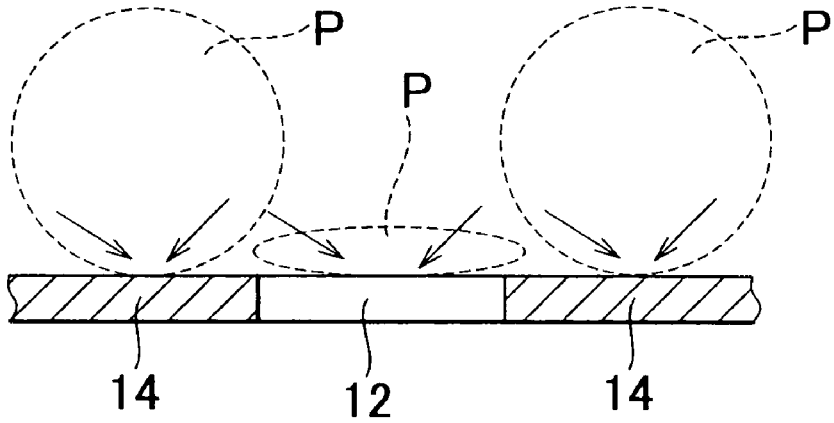
FIGS. 3A and 3B are sectional views illustrating the action of the composite coating according to the first example embodiment of the invention.

The action of the composite coating 10 will now be described with reference to FIG. 3. When fuel droplets P contact a portion where a lipophilic PES area 12 and an oil repelling FEP area 14 are alternately arranged, forces in the directions of the arrows act on the fuel droplets P on those areas, as shown in FIG. 3A. As a result, the fuel droplets P try to form individual droplets P on each area as hypothetically shown by the dotted lines.

Figure 3B:
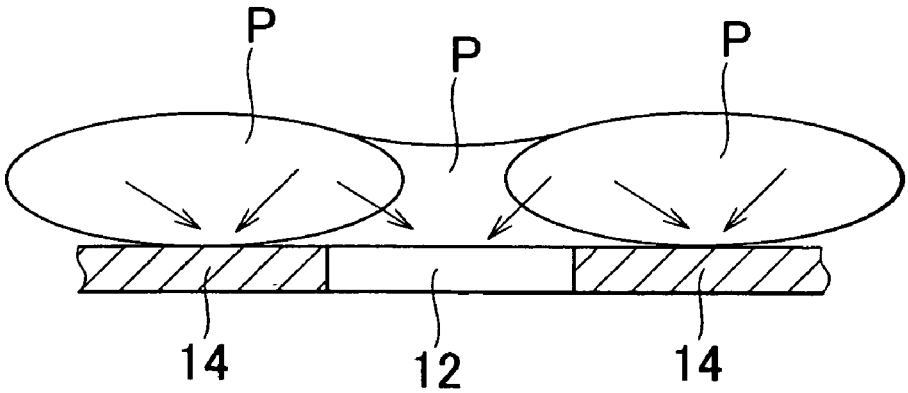

In actuality, however, because the lipophilic PES areas 12 and the oil repelling FEP areas 14 are alternately arranged on the nano order, the forces shown by the arrows in FIG. 3B act on the fuel droplets P on the molecular level of the fuel. As a result, the fuel droplets P do not exist independently on each area but instead spread out thinly as a fuel liquid film 4 (FIG. 1) with adjacent droplets connecting with each other. At this time, wettability is ensured by the attraction from the lipophilic portions 12, while at the same time slidability is ensured by the repulsive force from the oil repelling portions 14. Accordingly, the fuel liquid film 4 is easily able to slide while spreading out thinly over the composite coating 10. As a result, the thin fuel liquid film 4 is injected from the nozzle hole 3 without leading to an increase in pressure loss, and is easily broken up and atomized.

As a specific example of this example embodiment, a PES/FEP composite coating 10 approximately 2 to 5 μm thick can be formed by applying a PES/FEP mixed solution (e.g., with a PES/FEP ratio of 70/30) to the inside wall of the nozzle hole 3 by a method such as spraying or dipping, and then performing primary firing (e.g., at 180 degrees Celsius for 30 minutes) and secondary firing (e.g., at 350 degrees Celsius for 30 minutes).

Figure 4A:
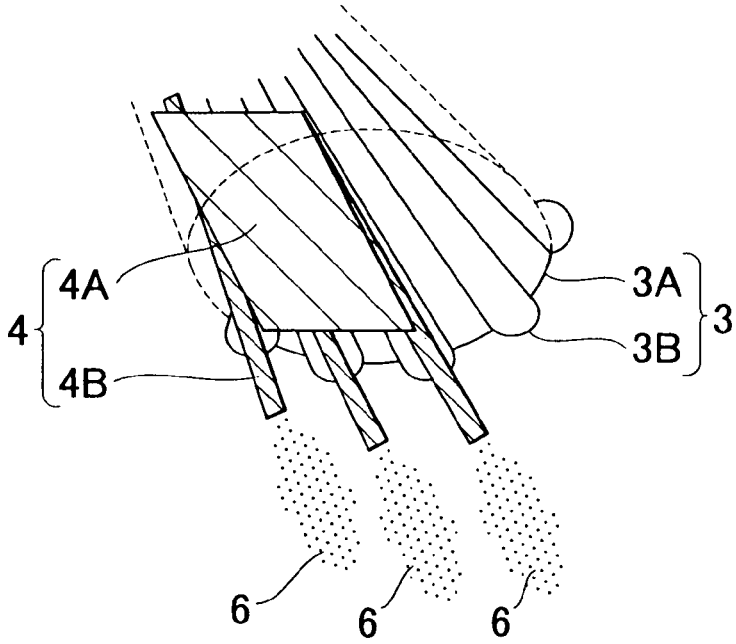
FIG. 4 is a view showing a nozzle hole portion of a fuel injection valve for an internal combustion engine according to a second example embodiment of the invention, with FIG. 4A being a perspective view and FIG. 4B being a sectional view.
Figure 4B:
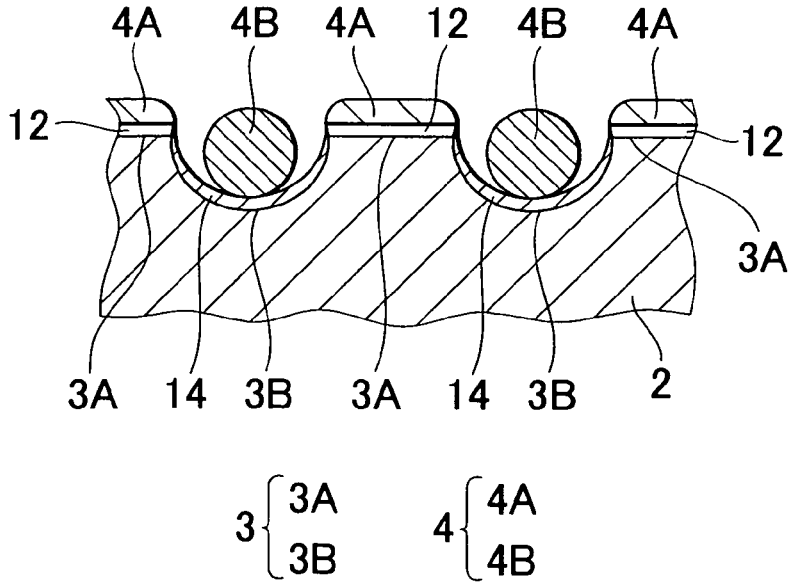

The principle of spray atomization according to a second example embodiment of the invention will now be described with reference to FIG. 4. FIG. 4A is a perspective view of the area near the outlet of the nozzle hole 3 (the surrounding area is not shown) and FIG. 4B is a transverse sectional view in which a portion near the inside wall of the nozzle hole 3 is shown enlarged.

A characteristic of the second example embodiment is that flat portions 3A and grooves 3B in the fuel jet direction are alternately arranged on the inside wall of the nozzle hole 3. The flat portions 3A are covered with a lipophilic coating 12 of PES, while the inside walls of the grooves 3B are covered with an oil repellant coating 14 of FEP.

Fuel spreads as a thin liquid film 4A over the lipophilic flat portions 3A, but spreads long and thin as liquid threads 4B with round cross-sections due to its own surface tension in the oil repellant grooves 3B. The fuel on the lipophilic flat portions 3A flows relatively slowly due to resistance from wetting, while the fuel in the oil repellant grooves 3B flows relatively fast due the resistance of the grooves 3B to wetting. The difference in these two flow rates produces shearing force at the boundary between the liquid film 4A on the flat portions 3A and the liquid threads 4B in the grooves 3B. This shearing force rips the two apart and divides them into the thin liquid film 4A on the flat portions 3A and the liquid threads 4B in the grooves 3B, as shown in FIG. 4B. The fuel is then injected from the nozzle hole 3 in this state so both the thin liquid film 4A and the long thin liquid threads 4B are broken apart easily resulting in atomized spray 6.

An additional effect of this example embodiment is that the direction in which the spray is injected is stabilized by the jet of fuel being guided by the grooves 3B.

As a specific example of this example embodiment, the nozzle hole diameter is approximately 0.2 mm, and the grooves 3B are approximately 30 μm deep and approximately 30 μm wide. For example, the grooves can be formed by electrical discharge machining or other such method. PES (a lipophilic agent) can be applied with a roller or the like to the flat portions 3A and FEP (an oil repelling agent) can be applied by dipping or the like to the grooves 3B.

While PES was given as the most preferable lipophilic agent and FEP was given as the most preferable oil repelling agent in the foregoing description, the invention is not limited to these. For example, a lipophilic agent other than PES, such as organic silicon or TiO2, can be used and an oil repelling agent other than FEP, such as CF (fluorocarbon) or PTFE, can be used.

What is claimed is:

1. A fuel injection valve for an internal combustion engine, wherein an inside wall of a nozzle hole through which fuel is injected into one of a combustion chamber and an intake port of the internal combustion engine comprises multiple grooves extending in the fuel jet direction and flat portions between these grooves, and inside walls of the grooves are coated with an oil repellant coating and the flat portions are coated with a lipophilic coating.

2. The fuel injection valve for an internal combustion engine according to claim 1, wherein the lipophilic portion comprises at least one of PES, organic silicon and TiO2, and the oil repelling portion is formed of at least one of FEP, CE (fluorocarbon), and PTFE.

3. The fuel injection valve for an internal combustion engine according to claim 2, wherein the oil repelling portion comprises FEP and the lipophilic portion comprises PES.

4. The fuel injection valve for an internal combustion engine according to claim 1, wherein the nozzle hole has a diameter of approximately 0.2 mm and the grooves have depths of approximately 30 μm and widths of approximately 30 μm.

5. A fuel injection valve for an internal combustion engine, comprising:

a needle valve; and a valve body having a nozzle hole for injecting fuel into one of a combustion chamber and an intake port of the internal combustion engine, wherein an inside wall of the nozzle hole includes multiple grooves extending in the fuel jet direction and flat portions between these grooves, and inside walls of the grooves are coated with an oil repellant coating and the flat portions are coated with a lipophilic coating.

* * * * *

UNITED STATES PATENT AND TRADEMARK OFFICE

CERTIFICATE OF CORRECTION

PATENT NO. : 7,651,038 B2
APPLICATION NO. : 11/476112
DATED : January 26, 2010
INVENTOR(S) : Shimizu et al.

It is certified that error appears in the above-identified patent and that said Letters Patent is hereby corrected as shown below:

On the title page, Item (73), the Assignee's information is incorrect. Item (73) should read:

-- (73) Assignee: Toyota Jidosha Kabushiki Kaisha,
Toyota-shi (JP) --

Signed and Sealed this

Sixth Day of April, 2010

David J. Kappos

David J. Kappos
*Director of the United States Patent and Trademark Office*